US011615928B2

(12) United States Patent
Zirr

(10) Patent No.: US 11,615,928 B2
(45) Date of Patent: Mar. 28, 2023

(54) KEYBOARD BUTTON

(71) Applicant: VOYETRA TURTLE BEACH, INC., White Plains, NY (US)

(72) Inventor: Kristian Zirr, Hamburg (DE)

(73) Assignee: Voyetra Turtle Beach, Inc., White Plains, NY (US)

( * ) Notice: Subject to any disclaimer, the term of this patent is extended or adjusted under 35 U.S.C. 154(b) by 0 days.

(21) Appl. No.: 17/465,631

(22) Filed: Sep. 2, 2021

(65) Prior Publication Data

US 2022/0068577 A1 Mar. 3, 2022

(30) Foreign Application Priority Data

Sep. 3, 2020 (CN) ..... 202021896782.9

(51) Int. Cl.
*H01H 13/85* (2006.01)
*H01H 13/52* (2006.01)

(52) U.S. Cl.
CPC ..... *H01H 13/85* (2013.01); *H01H 13/52* (2013.01); *H01H 2215/028* (2013.01)

(58) Field of Classification Search
CPC ..... G06F 3/00; G06F 3/02; H03K 17/975; H03K 17/9622; H03K 17/98; H03K 2217/96077; H01H 2221/00; H01H 2221/008; H01H 2223/00; H01H 2223/002; H01H 2223/004; H01H 2223/006; H01H 2223/008; H01H 2223/01; H01H 2223/03; H01H 2223/032; H01H 2223/038; H01H 2223/042; H01H 2223/044; H01H 2223/05; H01H 2223/07; H01H 2235/006; H01H 2235/02; H01H 1/00; H01H 1/12; H01H 1/14; H01H 3/00; H01H 3/12; H01H 3/32; H01H 5/00; H01H 13/00; H01H 13/04; H01H 13/14; H01H 13/26; H01H 13/28; H01H 13/50; H01H 13/52; H01H 13/70;
(Continued)

(56) References Cited

U.S. PATENT DOCUMENTS 8,847,890 B2 * 9/2014 Peterson ..... H01H 13/85 200/344
10,102,987 B1 * 10/2018 Alexander ..... H01H 13/78
(Continued)

FOREIGN PATENT DOCUMENTS

EP 3611600 A1 2/2020

*Primary Examiner* — Anthony R Jimenez
(74) *Attorney, Agent, or Firm* — Sheppard Mullin Richter & Hampton LLP

(57) ABSTRACT

The shell is provided with an axial opening at the top and a guide track structure inside. The movable terminal is provided inside the shell and forms an arm spring. The actuating lever is threaded through the axial opening, with a flat slope on one side and a positioning slope on the other. The actuating lever is provided with a guiding structure, and the positioning slope is provided with a positioning structure. Moving upwards along the circumference, the actuating lever has a position 1 and a position 2. When the actuating lever is at position 1 or position 2, the guiding structure joins the guide track structure. When the actuating lever is at position 1, the arm spring comes into contact with the flat slope and slips. When the actuating lever is at position 2, the arm spring comes into contact with the positioning slope and slips.

12 Claims, 9 Drawing Sheets

(58) Field of Classification Search
CPC .. H01H 13/705; H01H 13/85; H01H 2205/00;
H01H 2215/00; H01H 2215/028
USPC ..... 200/341
See application file for complete search history.

(56) References Cited

U.S. PATENT DOCUMENTS

| | | | |
|---|---|---|---|
| 2018/0006648 | A1 | 1/2018 | Liu |
| 2018/0074587 | A1 | 3/2018 | Liu |
| 2019/0172661 | A1 | 6/2019 | Hsieh et al. |

* cited by examiner

KEYBOARD BUTTON

REFERENCE TO RELATED APPLICATION

The present application claims priority to Chinese Patent Application No. 202021896782.9, filed Sep. 3, 2020 and titled "KEYBOARD BUTTON," which is incorporated herein by reference in its entirety.

TECHNICAL FIELD

This utility model relates to a keyboard key, and in particular, to a keyboard key that can provide changeable tactile sensations when pressed.

BACKGROUND ART

Exiting keyboard keys can provide two different tactile sensations, a smooth pressing sensation and a short press sensation. A single ordinary keyboard key provides only one sensation, the smooth one or the short one, determined at the factory, and is unable to provide both sensations. The provision of different tactile sensations in one keyboard doubles the production costs of manufacturers and is not economically efficient, resulting in fewer keyboard options for users.

The Inventor devoted himself to solving this problem with the aforesaid existing technologies and theories, intending to make improvements.

DESCRIPTION OF UTILITY MODEL

This utility model relates to a keyboard key providing changeable tactile sensations.

This utility model relates to a keyboard key that comprises a shell, a fixed terminal, a movable terminal, and an actuating lever. The shell, with a top and a bottom corresponding to the top, is provided with an axial opening at the top and a guide track structure inside that is longitudinally parallel to the central axis of the axial opening. The fixed terminal is fixed inside the shell. The movable terminal is provided inside the shell and extends to form an arm spring. The actuating lever, with a flat slope on one side and a positioning slope on the other, is threaded through the axial opening, can longitudinally move between an initial position and a trigger position, and is provided with a guiding structure. The flat slope and the positioning slope extend laterally away from the actuating lever, and extend longitudinally to the bottom of the shell, and the positioning slope is provided with a positioning structure.

Moving upwards along the circumference, the actuating lever has a position 1 corresponding to the flat slope and a position 2 corresponding to the positioning slope. When the actuating lever is at position 1 or position 2, the guiding structure joins the guide track structure.

When the actuating lever is at position 1 and then moves from the initial position toward the bottom of the shell and to the trigger position, the arm spring comes into contact with the flat slope and slips along the flat slope to its end.

When the actuating lever is at position 2 and then moves from the initial position toward the bottom of the shell and to the trigger position, the arm spring comes into contact with the positioning slope and slips along the positioning slope to its end.

The keyboard key of this utility model also comprises a fixed terminal fixed inside the shell, which separates from the movable terminal when the arm spring comes into contact with the flat slope and slips to the end of the flat slope. After the arm spring separates itself from the end of the flat slope and the movable terminal recovers and comes into contact with the fixed terminal, the arm spring comes into contact with the positioning slope and slips to the end of the positioning slope. The arm spring can slip over the positioning structure, and when it separates itself from the end of the flat slope, the movable terminal recovers and comes into contact with the fixed terminal. When the arm spring comes into contact with the root of the flat slope or positioning slope, the movable terminal comes into contact with the fixed terminal.

The positioning structure in the keyboard key of this utility model is concave or convex on the positioning slope.

The shell of the keyboard key of this utility model comprises a base and a translucent cover covering the base, and the guide track structure and the movable terminal are provided in the base. The axial opening is provided in the translucent cover.

The actuating lever of the keyboard key of this utility model is provided with a convex arm spring clamp on the side. When the actuating lever is at the initial position, the arm spring clamp comes into contact with the shell.

The actuating lever of the keyboard key of this utility model is provided with a push rod 1 and a push rod 2 extending from its respective sides. The flat slope and the positioning slope are formed on push rod 1 and push rod 2, respectively.

The keyboard key of this utility model also comprises an elastic member that is connected to the shell and the actuating lever to push the actuating lever towards the initial position.

The guide track structure of the keyboard key of this utility model comprises one track 1, and the guiding structure comprises two track 2s corresponding to position 1 and position 2, respectively. Track 1 can join either of the track 2s. Or, the guide track structure comprises several track 1s corresponding to position 1 and position 2, respectively. The guiding structure comprises one track 2 that can join any of the track 1s. Or, the guide track structure comprises several track 1s corresponding to position 1 and position 2, respectively. The guiding structure comprises several track 2s corresponding to position 1 and position 2, respectively, and each of the track is can join any of the corresponding track 2s.

The actuating lever of the keyboard key of this utility model is provided with flat slopes and positioning slopes on multiple sides respectively, as well as guiding structures that can always join the guide track structures when the actuating lever is at any corresponding angle, so the actuating lever can move to make any flat slope or any positioning slope come into contact with the arm spring. When the arm spring comes into contact with the flat slope or the positioning slope and slips along it, the key provides different tactile sensations when pressed. In this way, the keyboard key of this utility model provides changeable tactile sensations.

SUMMARY

In general, one aspect disclosed features a keyboard key that is characterized by the following components: a shell, with a top and a bottom corresponding to the top, that is provided with an axial opening at the top and a guide track structure inside that is longitudinally parallel to the central axis of the axial opening; a movable terminal that is provided inside the shell and extends to form an arm spring; and an actuating lever, with a flat slope on one side and a positioning slope on the other, that is threaded through the axial opening, can longitudinally move between an initial position and a trigger position, and is provided with a guiding structure; the flat slope and the positioning slope extend laterally and away from the actuating lever and extend longitudinally to the bottom of the shell; the positioning slope is provided with a positioning structure; in particular, upwards along the circumference, the actuating lever has a position 1 corresponding to the flat slope and a position 2 corresponding to the positioning slope; when the actuating lever is at position 1 or position 2, the guiding structure joins the guide track structure; when the actuating lever is at position 1 and then moves from the initial position toward the bottom of the shell and to the trigger position, the arm spring comes into contact with the flat slope and slips along the flat slope to its end to open or close; when the actuating lever is at position 2 and then moves from the initial position toward the bottom of the shell and to the trigger position, the arm spring comes into contact with the positioning slope and slips along the positioning slope to its end.

Embodiments of the method may include one or more of the following features. In some embodiments, the keyboard key comprises a fixed terminal fixed inside the shell, which separates from the movable terminal when the arm spring comes into contact with the flat slope and slips to the end of the flat slope; after the arm spring separates itself from the end of the flat slope and the movable terminal recovers and comes into contact with the fixed terminal, the arm spring comes into contact with the positioning slope and slips to the end of the positioning slope; the arm spring can slip over the positioning structure, and when it separates itself from the end of the flat slope, the movable terminal recovers and comes into contact with the fixed terminal. In some embodiments, when the arm spring comes into contact with the root of the flat slope or positioning slope, the movable terminal comes into contact with the fixed terminal. In some embodiments, the positioning structure is concave or convex on the positioning slope. In some embodiments, the shell comprises a base and a translucent cover covering the base; the guide track structure and the movable terminal are provided in the base. In some embodiments, the axial opening is provided in the translucent cover. In some embodiments, the actuating lever is provided with a convex arm spring clamp on the side; when the actuating lever is at the initial position, the arm spring clamp comes into contact with the shell. In some embodiments, the actuating lever is provided with a push rod 1 and a push rod 2 extending from its respective sides; the flat slope and the positioning slope are formed on push rod 1 and push rod 2, respectively. In some embodiments, the keyboard key also comprises an elastic member that is connected to the shell and the actuating lever in order to push the actuating lever towards its initial position. In some embodiments, the guide track structure comprises one track 1, and the guiding structure comprises two track 2s corresponding to position 1 and position 2, respectively; track 1 can join either of the track 2s. In some embodiments, the guide track structure comprises several track 1s corresponding to position 1 and position 2, respectively; the guiding structure comprises one track 2 that can join any of the track 1 s. In some embodiments, the guide track structure comprises several track 1s corresponding to position 1 and position 2, respectively; the guiding structure comprises several track 2s corresponding to position 1 and position 2, respectively, and each of the track 1s can join any of the corresponding track 2s.

DRAWING REFERENCE NUMERALS

Figure 1:
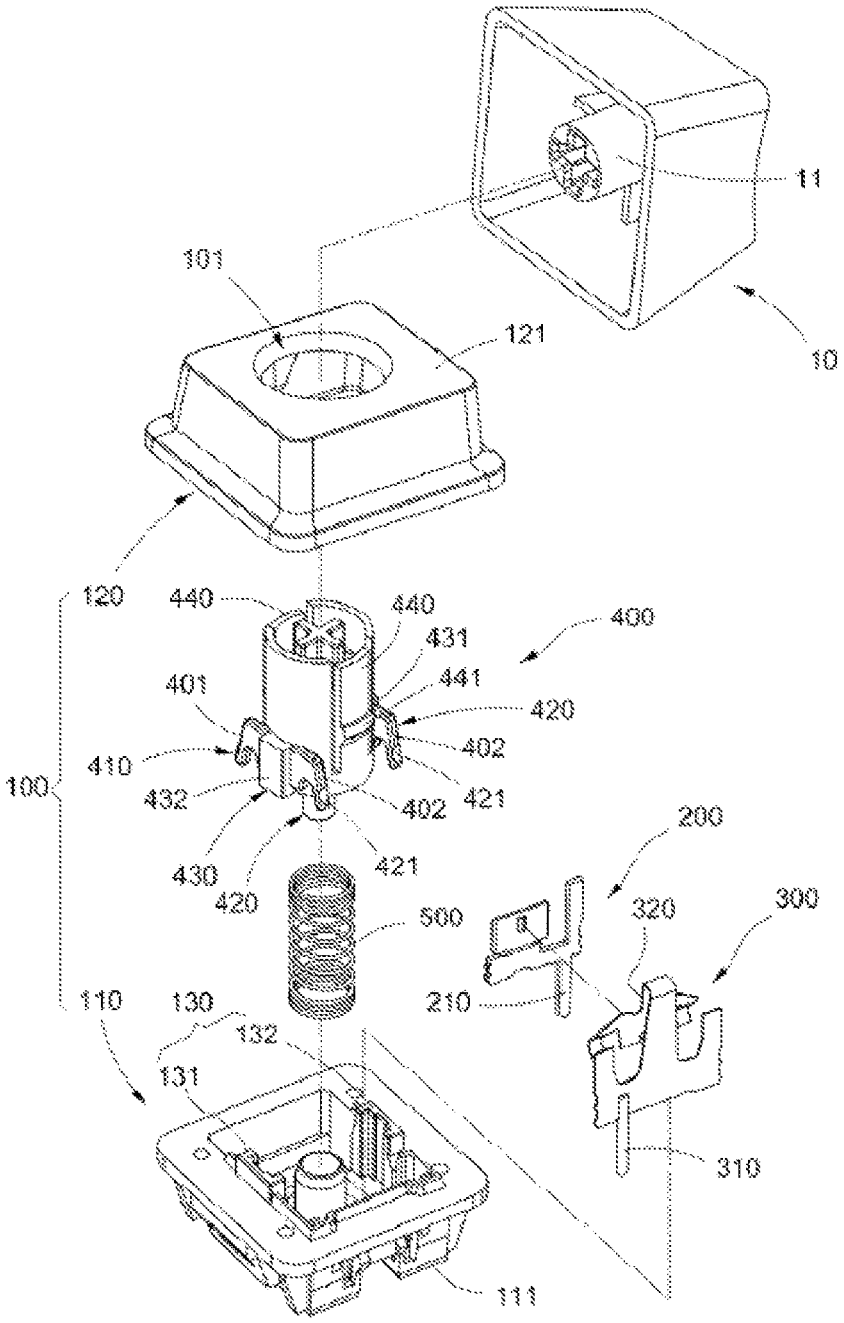
FIG. 1 is a 3D exploded view of the keyboard key in a preferred embodiment of this utility model.

10: Keycap
11: Connecting sleeve
100: Shell
101: Axial opening
111: Bottom
110: Base
120: Translucent cover
121: Top
130: Guide track structure
131/132: track 1
200: fixed terminal
210: Pin
300: Movable terminal
310: Pin
320: Arm spring
400: Actuating lever
401: Flat slope
402: Positioning slope
410: Push Rod 1
420: Push Rod 2
421: Positioning structure
430: Guiding structure
431/432: Track 2
440: Arm spring clamp
441: Hook
500: Elastic member

SPECIFIC EMBODIMENTS

Figure 2:
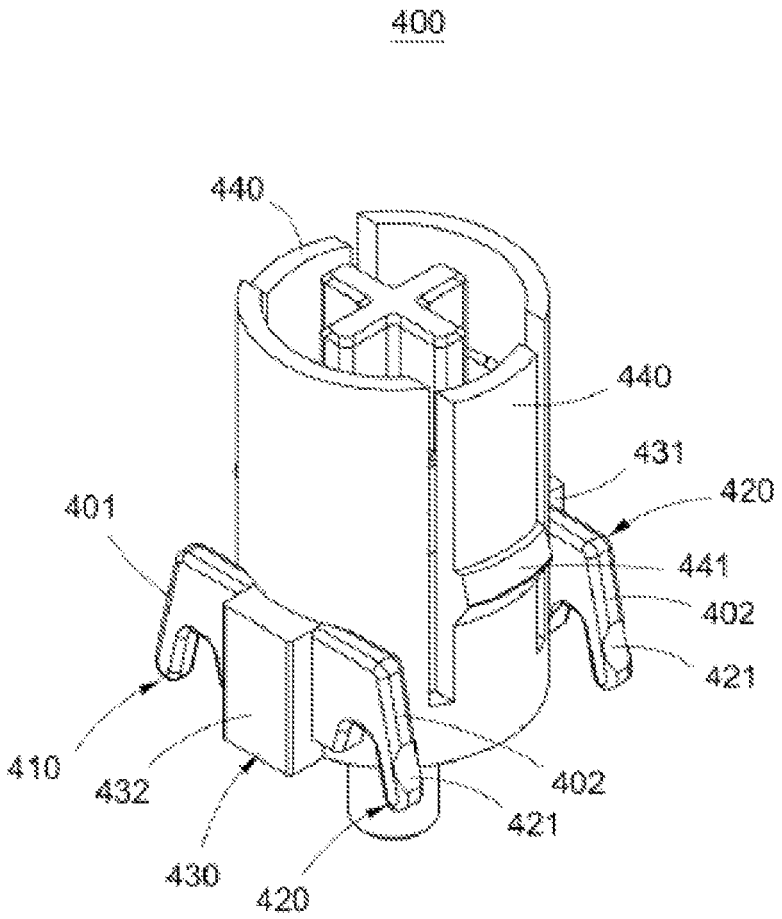
FIG. 2 is a 3D view of the actuating lever of the keyboard key in a preferred embodiment of this utility model.
Figure 3:
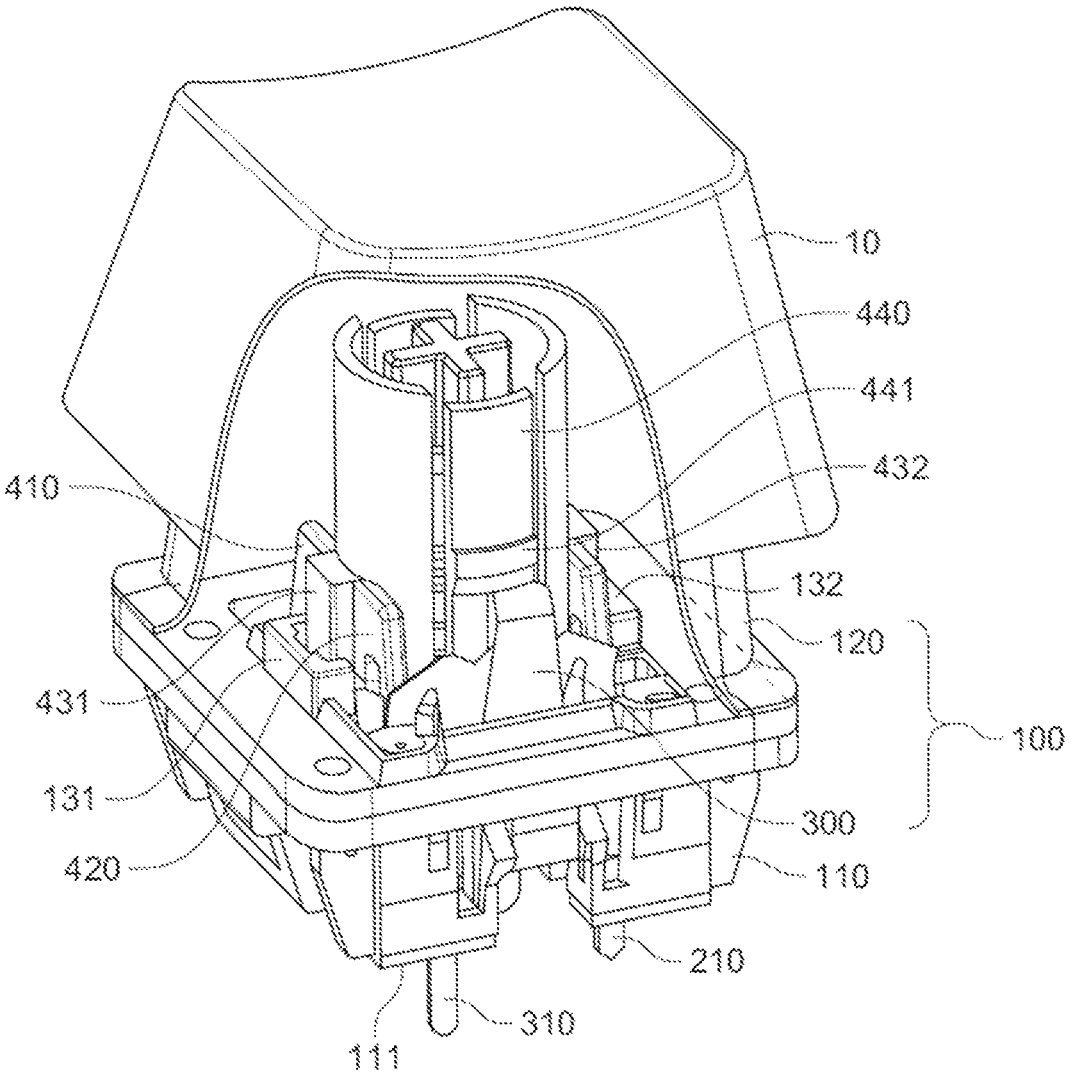
FIG. 3 is a 3D view of the keyboard key in a preferred embodiment of this utility model.

As shown in FIG. 1 to FIG. 3, this utility model relates to a keyboard key that comprises a shell 100, a fixed terminal 200, a movable terminal 300, an actuating lever 400, and an elastic member 500. The shell 100 is provided with a guide track structure 130, which is longitudinally parallel to the central axis of the axial opening 101. Specifically, the shell 100 comprises a base 110 and a translucent cover 120, where the base 110 forms the bottom 111 of the shell 100 and is provided with the guide track structure 130 inside. The translucent cover 120 covers the base 110 and forms the top 121 of the shell 100, with the axial opening 101 in it.

The fixed terminal 200 is fixed in the shell 100. In this embodiment, the fixed terminal 200 is a mechanical fixed terminal made of a metal plate triggered by contact and conduction, a part of which is embedded in the base 110 and extends out through the base 110 and forms a pin 210, and the other part of which extends to the inside of the base 110. However, this embodiment shall not limit this utility model. The fixed terminal 200 can also be an optical fixed terminal that is triggered by a light beam disruption.

The movable terminal 300 is provided inside the shell 100 and extends to form an arm spring 320. Specifically, the movable terminal 300 is made of a metal plate, a part of which is embedded in the base 110 and extends out through the base 110 and forms a pin 310, and the other part of which extends to the inside of the base 110 and forms the arm spring 320. In this embodiment, the movable terminal 300 preferably forms two arm springs 320, which function in the same way, one of which will be explained hereinafter.

Figure 4:
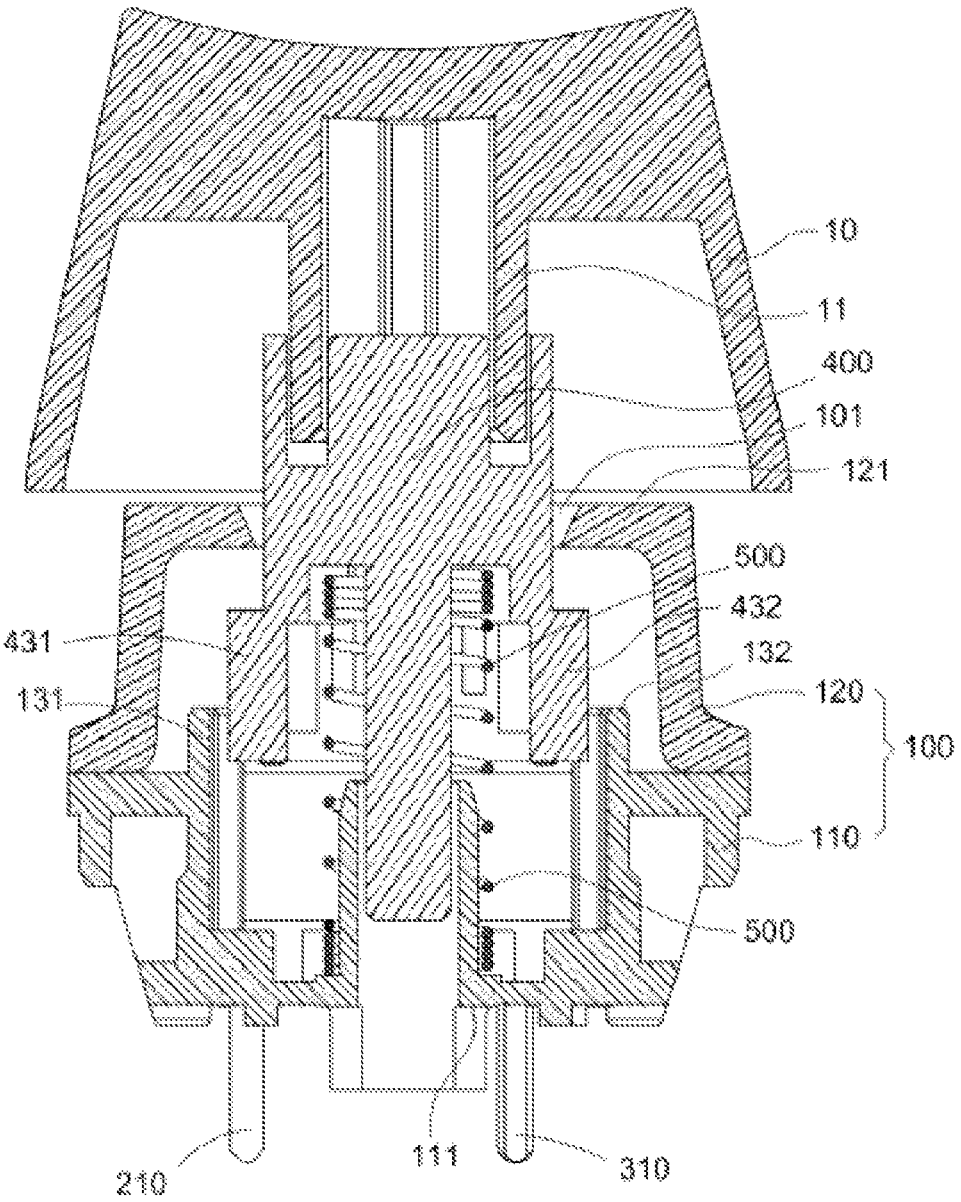
FIG. 4 is the initial position of the keyboard key in a preferred embodiment of this utility model.
Figure 5:
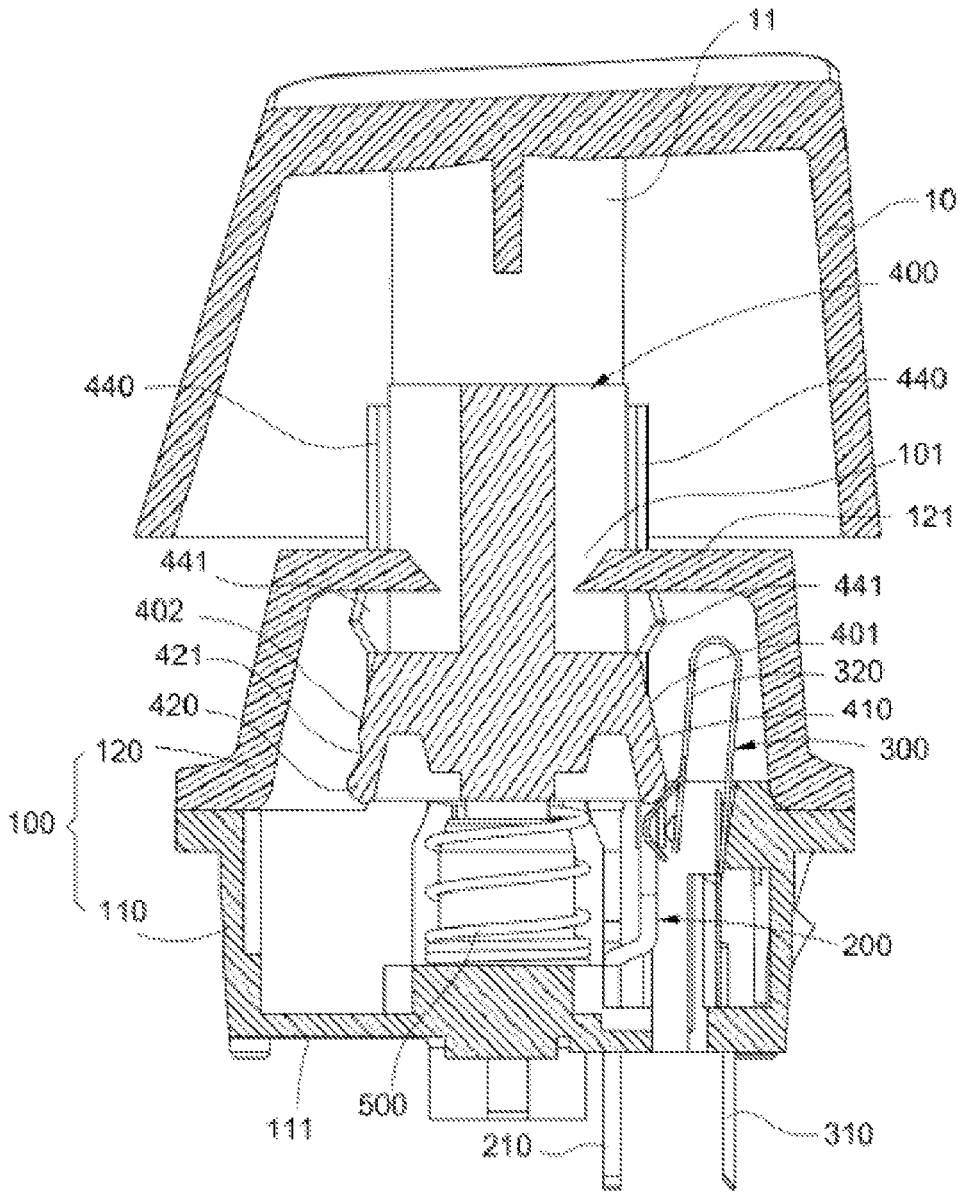
FIG. 5 is the actuating lever of the keyboard key at position 1 in a preferred embodiment of this utility model.
Figure 6:
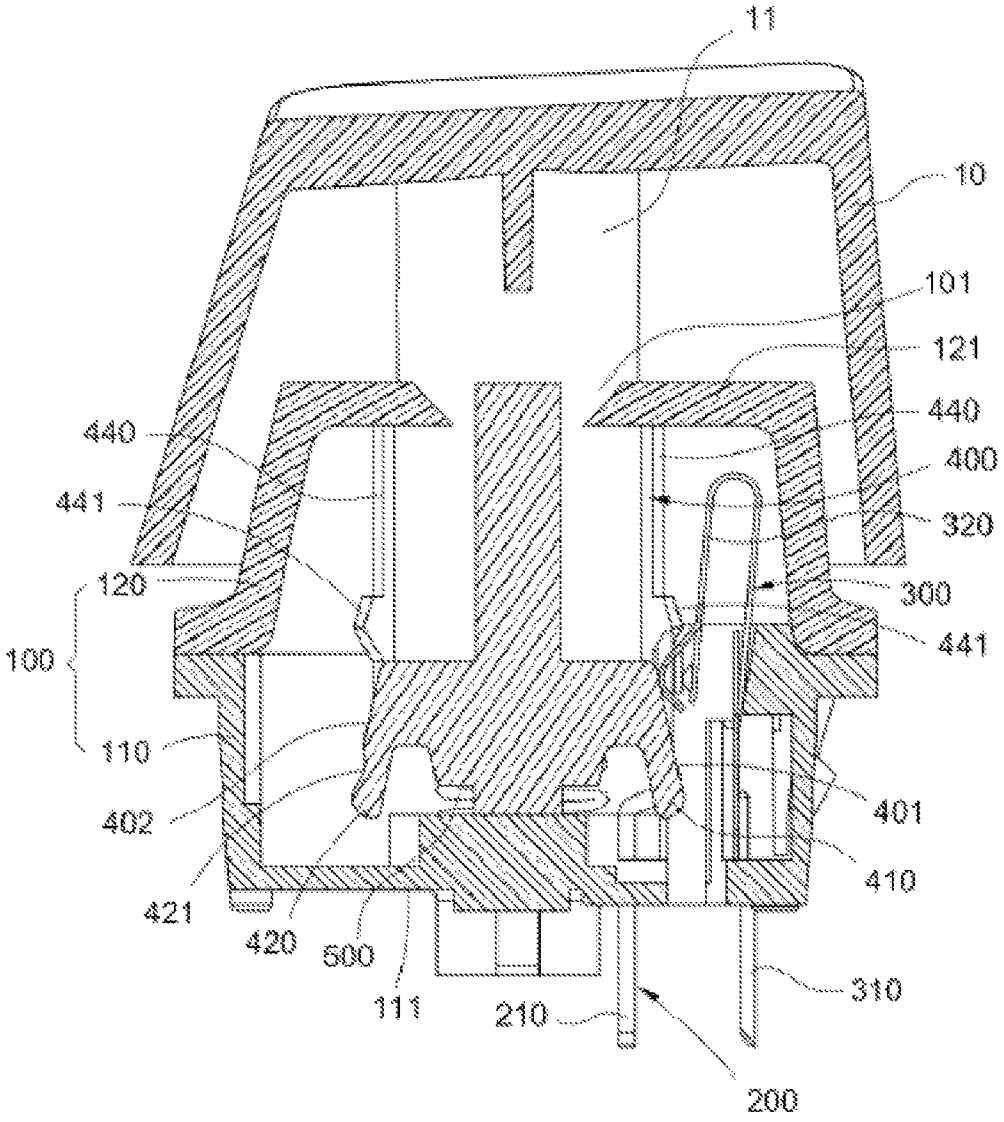
FIG. 6 is the trigger position when the actuating lever of the keyboard key is at position 1 in a preferred embodiment of this utility model.

As shown in FIG. 1 and FIG. 3, the actuating lever 400 is threaded through the axial opening 101 and can longitudinally move between an initial position, as shown in FIG. 4 and FIG. 5, and a trigger position, as shown in FIG. 6. As shown in FIG. 1, the actuating lever 400 extends through one end of the shell 100 for a keycap 10. As shown in FIG. 6, the trigger position approaches closer to the bottom 111 of the shell 100 than the initial position in FIG. 4 and FIG. 5. In this embodiment, the actuating lever 400, as shown in FIG. 1 and FIG. 2, preferably has an internal part of it hollowed out so that the keycap 10 can be connected to the actuating lever 400 through the hollow space with a connecting sleeve 11. The actuating lever 400 is provided with a flat slope 401 on one side and a positioning slope 402 on the other, as well as a guiding structure 430. The flat slope 401 and the positioning slope 402 extend laterally away from the actuating lever 400 and extend longitudinally to the bottom 111 of the shell 100. The positioning slope 402 is provided with a positioning structure 421. In this embodiment, the actuating lever 400 is preferably provided with a pair of identical flat slopes 401 and a pair of identical positioning slopes 402 corresponding to the forked ends of the arm spring 320, so as to enable the arm spring 320 to evenly distribute the force on both sides for better stability. One of the flat slopes 401 and one of the positioning slopes 402 will be explained hereinafter.

In this embodiment, preferably, corresponding to the forked ends of the described arm spring 320, a pair of identical and parallel push rods 1 410 extend slantwise from one side of the actuating lever 400 to the bottom 111 of the base 110, and a pair of identical and parallel push rods 2 420 extend slantwise from the other side of the actuating lever 400 to the bottom 111 of the base 110. One of the push rods 1 410 and one of the push rods 2 420 will be explained hereinafter. The described flat slope 401 forms on the surface of push rod 1 410, and the described positioning slope 402 forms on the surface of push rod 2 420.

Figure 7:
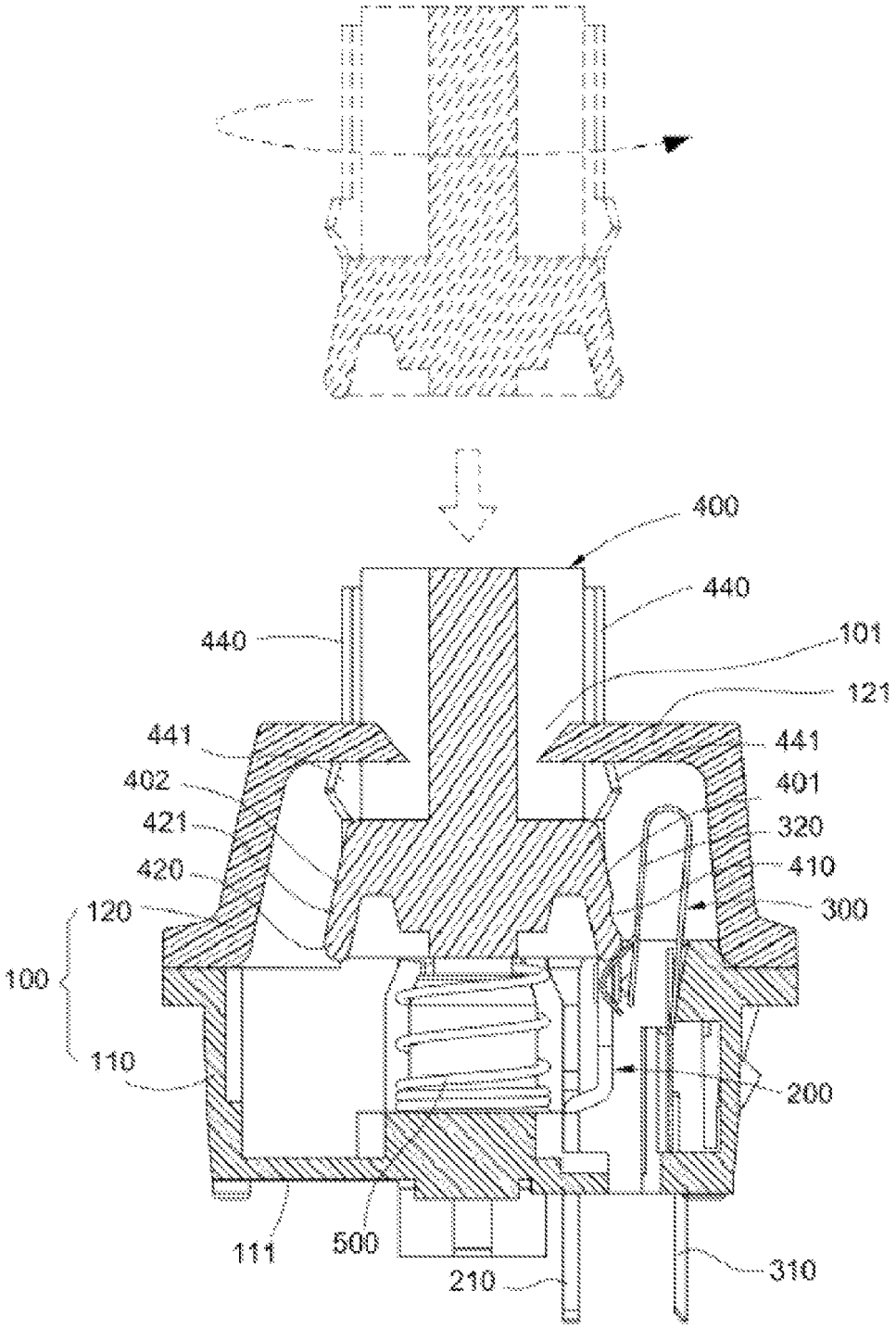
FIG. 7 is the actuating lever of the keyboard key swinging to position 2 in a preferred embodiment of this utility model.
Figure 8:
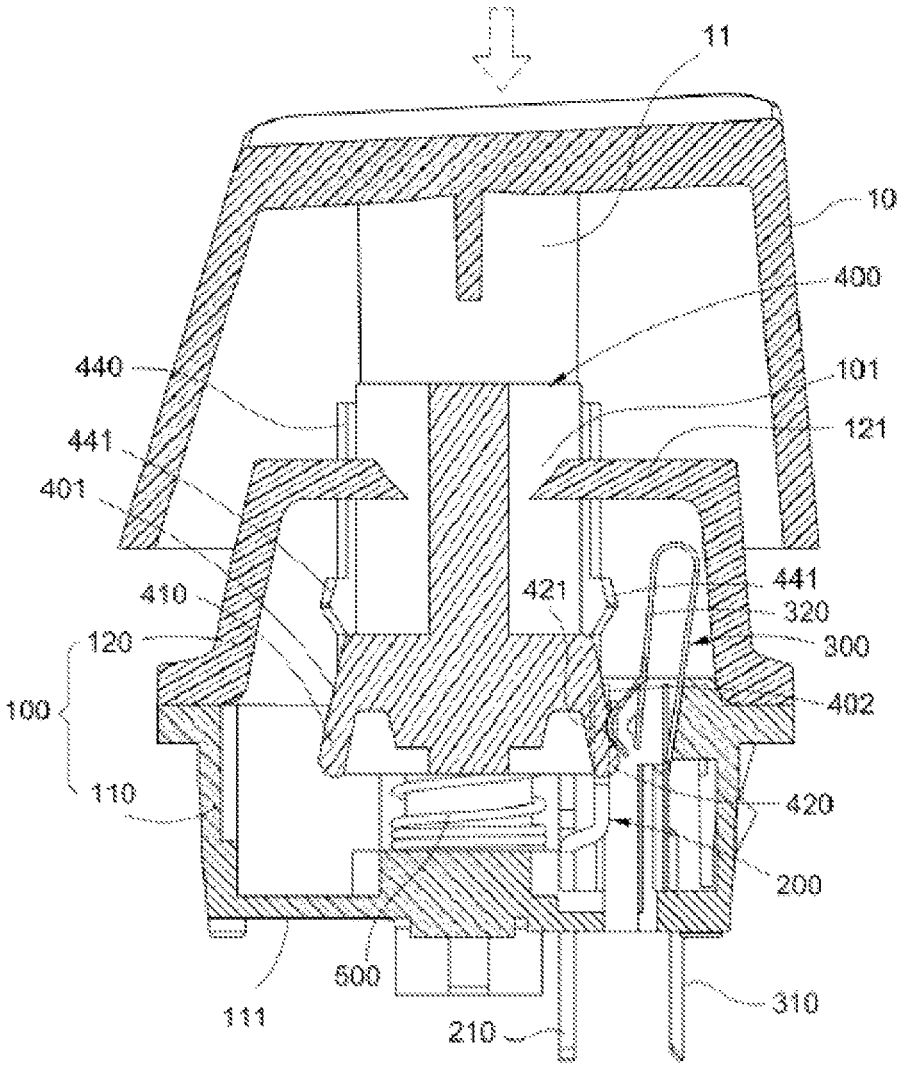
FIG. 8 is the key-press action when the actuating lever of the keyboard key is at position 2 in a preferred embodiment of this utility model.
Figure 9:
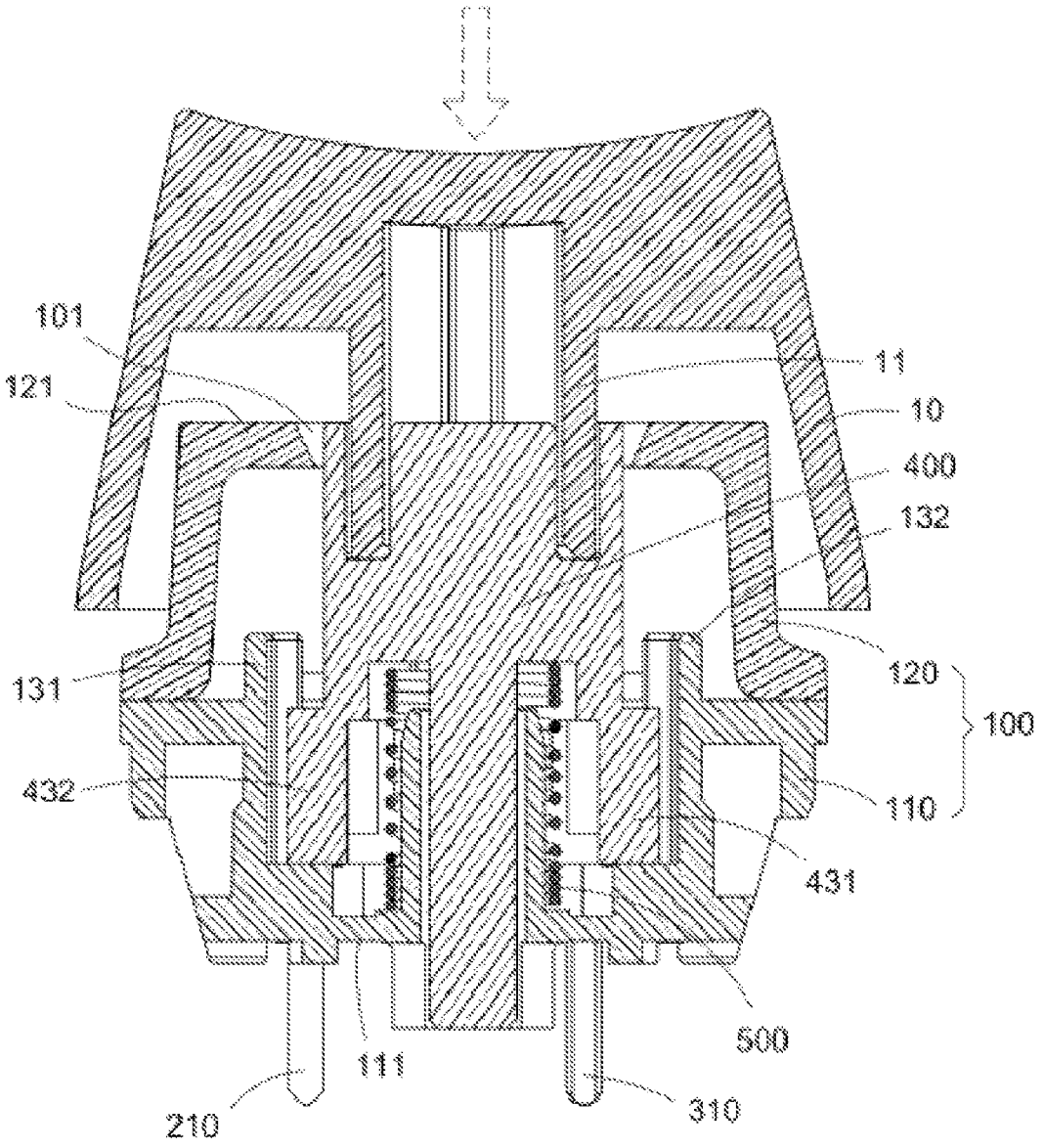
FIG. 9 is the trigger position when the actuating lever of the keyboard key is at position 2 in a preferred embodiment of this utility model.

The actuating lever 400, upwards along its circumference, has a position 1 corresponding to the flat slope 401, as shown in FIG. 4 to FIG. 6, and a position 2 corresponding to the positioning slope 402, as shown in FIG. 7 to FIG. 9. When it is at position 1 or position 2, the guiding structure 430 can join the guide track structure 130.

As shown in FIGS. 1, 3, and 4, the elastic member 500 is preferably a cylinder spring in this embodiment, but it shall not limit this utility model. The two ends of the elastic member 500 come into contact with the inner bottom of the base 110 and the actuating lever 400, respectively, to push the actuating lever 400 to the initial position and to maintain the actuating lever 400 at the lifted initial position when not pressed.

Moreover, as shown in FIGS. 1 and 5, the actuating lever 400 is provided with a convex arm spring clamp 440 on the side, which comes into contact with the inner wall of the shell 100 when the actuating lever 400 is at the initial position to prevent the actuating lever 400 from protruding through the axial opening 101. In this embodiment, the hook 441 of the arm spring clamp 440 is preferably formed in the middle section and comes into contact with the inner wall of the inner edge of the axial opening 101. The arm spring clamp 440 further extends through the axial opening 101 and out of the shell 100. In this way, the user can get the hook 441 out of the shell 100 by pressing the end of the arm spring clamp 440 to facilitate the separation of the guide track structure 130 from the guiding structure 430. However, when the keycap 10 is mounted to the actuating lever 400, its connecting sleeve 11 rests against the inner wall of the arm spring clamp 440 so that the arm spring clamp 440 cannot leave the shell 100. Preferably, the hook 441 can be at an obtuse angle, allowing the user to separate the guide track structure 130 from the guiding structure 430 when the arm spring clamp 440 is pressed but not fully out of the shell 100.

As shown in FIG. 4 to FIG. 6, preferably, when the actuating lever 400 is at the initial position, the arm spring 320 comes into contact with the root of the flat slope 401 or the positioning slope 402. At this point, the movable terminal 300 can be set to contact the fixed terminal 200 via a part of the arm spring 320 so that it comes into contact with the fixed terminal 200 to detect that it is at the initial position.

As shown in FIG. 4 to FIG. 6, when the actuating lever 400 is at position 1 and then moves towards the bottom 111 of the shell 100 to the trigger position after being pressed, the arm spring 320 comes into contact with the flat slope 401 and slips along the flat slope to its end to separate the movable terminal 300 from the fixed terminal 200. After the arm spring 320 separates itself from the end of the flat slope 401, the arm spring 320 recovers and comes into contact with the fixed terminal 200. This produces a signal break to enable the computer to detect the key press.

As shown in FIG. 7 to FIG. 9, when the actuating lever 400 is at position 2 and then moves towards the bottom 111 of the shell 100 to the trigger position, the arm spring 320 comes into contact with the positioning slope 402 and slips along the positioning to its end to separate the movable terminal 300 from the fixed terminal 200. The arm spring 320 can slip over the positioning structure 421, and when it separates itself from the end of the flat slope 401, it recovers and comes into contact with the fixed terminal 200.

The positioning structure 421 gives the positioning slope 420 an unsmooth surface. When the arm spring 320 slips over the positioning structure 421, the resistance caused by the positioning slope 402 to the arm spring 320 changes, allowing the user to sense a pause that indicates the key is pressed. Therefore, the positioning structure 421 can either be a concave part recessing into the positioning slope 402 or a convex part protruding from the positioning slope 402. In addition, the number of such concave parts or convex parts can be increased depending on the preset demand for tactile sensation. Therefore, this utility model shall not be limited in this respect. In this embodiment, the positioning structure 421 is preferably a concave part recessing into the positioning slope 402.

As shown in FIG. 1 and FIG. 2, in order to allow the guiding structure 430 of the actuating lever 400 to join the guide track structure 130 when the actuating lever 400 is at any corresponding angle, this utility model provides a configuration method corresponding to at least the following guiding structure 430 and the guide track structure 130.

The guide track structure 130 can comprise only one track 1 131, and the guiding structure 430 can comprise several track 2s 431/432, corresponding respectively to position 1 and position 2. Track 1 131 is a chute, and the track 2s 431/432 are the corresponding sliders, which are interchangeable. Track 2s 431/432 are identical so that track 1 131 can join either track 2 431/432. The number of track 2s 431/432 is the sum of the total number of the flat slopes 401 plus the total number of the positioning slopes 402, and each track 2 431/432 is configured corresponding to the angle of each flat slope 401 or each positioning slope 402, respectively. When the actuating lever 400 swings to position 1 or position 2, its corresponding flat slope 401 or positioning slope 402 comes into contact with the arm spring 320, and its corresponding track 2 431/432 joins track 1 131.

The guide track structure 130 can comprise several track 1s 131/132 corresponding respectively to position 1 and position 2, and the guiding structure 430 can comprise one track 2 431. The track is 131/132 are chutes, which are interchangeable, and track 2 431 is the corresponding slider. The track is 131/132 are identical so that track 2 431 can join any track 1 131/132. The number of track is 131/132 is the sum of the total number of the flat slopes 401 plus the total number of the positioning slopes 402. Each track 1 131/132 is configured corresponding to the angle of each flat slope 401 or each positioning slope 402, respectively. When the actuating lever 400 swings to position 1 or position 2, its corresponding flat slope 401 or positioning slope 402 comes into contact with the arm spring 320, and its corresponding track 1 131/132 joins track 2 431.

As shown in FIGS. 1, 2, 4, and 9 in this embodiment, the actuating lever 400 preferably has four sides. One opposite pair of the four sides is provided with one flat slope 401 and one positioning slope 402, and the other opposite pair is provided with two identical track 2s 431/432, one on each side, as well as two identical track is 131/132 that corresponding to them. In other words, in this embodiment, the actuating lever 400 has its position 1 180 degrees to its position 2 along its circumference, with the same operating principle as the configuration described above. In this embodiment, when the actuating lever 400 is at position 1 shown in FIG. 4 or position 2 shown in FIG. 9, any of track 1 131/132 can join any of track 2 431/432, and vice versa.

However, the guide track structure 130 may take forms other than the two described, and it may comprise two track 1s 131 corresponding respectively to position 1 and position 2, while the guiding structure 430 may comprise several track 2s 431/432 corresponding respectively to position 1 and position 2. The track is 131/132 and track 2s 431/432 are chutes and corresponding sliders, respectively, which are interchangeable. Each track 1 131/132 can join each track 2 431/432 respectively and correspondingly. Therefore, the track is 131/132 may take different forms, as may the track 2s 431/432. The number of track is 131/132 is the same as that of track 2s 431/432, both being the sum of the total number of the flat slopes 401 plus the total number of the positioning slopes 402. Each track 1 131/132 is configured to correspond to the angle of each flat slope 401 or positioning slope 402, respectively. When the actuating lever 400 swings to position 1 or position 2, its corresponding flat slope 401 or position slope 402 comes into contact with the arm spring 320, and at least its corresponding track 1 131/132 joins track 2 431/432, and the remaining track is 132/131 and track 2s 432/431 can be separated from each other and remain idle.

The actuating lever 400 of the keyboard key of this utility model is provided with flat slopes 401 and positioning slopes 402 on multiple sides, respectively, and the guiding structures 430 can always join the guide track structures 130 when the actuating lever is at any corresponding angle so that the actuating lever can swing to enable any flat slope 401 or any positioning slope 402 to come into contact with the arm spring 320. When the arm spring 320 comes into contact with the flat slope 401 or the positioning slope 402 and slips along it, the key provides different tactile sensations when pressed. In this way, the keyboard key of this utility model provides changeable tactile sensations.

When users need to change the tactile sensation, they must first remove the keycap 10 and then press the arm spring 320 so that the end of the latter goes through the axial opening 101 and moves out from the shell 100 to the actuating lever 400, making the guide track structure 130 separate from the guiding structure 430. After that, the actuating lever 400 swings to align the required flat slope 401 or positioning slope 402 with the arm spring 320, and then goes through the axial opening 101 and into the shell 100, making the guiding structure 430 rejoin the guide track structure 130.

The aforesaid is only a preferred embodiment of this utility model, which shall not limit the scope of protection of this utility model. Other equivalent variants exerting the patent idea of this utility model shall fall within the protection scope of this utility model.

What is claimed is:

1. A keyboard key comprising:

a shell, with a top and a bottom corresponding to the top, that is provided with an axial opening at the top and a guide track structure inside that is longitudinally parallel to the central axis of the axial opening;

a movable terminal that is provided inside the shell and extends to form an arm spring; and an actuating lever, with a flat slope on one side of the actuating lever and a ridged slope on an opposite side of the actuating lever, that is threaded through the axial opening, can longitudinally move between an initial position and a trigger position, and is provided with a guiding structure;

wherein the flat slope and the ridged slope extend laterally and away from the actuating lever and extend longitudinally toward the bottom of the shell;

wherein the ridged slope is provided with a ridged structure upwards along the circumference, the actuating lever is positionable in a first orientation corresponding to the flat slope and a second orientation corresponding to the ridged slope;

wherein, when the actuating lever is at the first or second orientation, the guiding structure joins the guide track structure;

wherein, when the actuating lever is at the first orientation and then moves from the initial position toward the bottom of the shell and to the trigger position, the arm spring comes into contact with the flat slope and slips along the flat slope to its end to open or close; and wherein, when the actuating lever is at the second orientation and then moves from the initial position toward the bottom of the shell and to the trigger position, the arm spring comes into contact with the ridged slope and slips along the ridged slope to its end.

2. The keyboard key as claimed in claim 1, wherein the ridged structure is concave or convex on the ridged slope.

3. The keyboard key as claimed in claim 1, wherein the actuating lever is provided with a convex arm spring clamp on the side; and wherein, when the actuating lever is at the initial position, the arm spring clamp comes into contact with the shell.

4. The keyboard key as claimed in claim 1, wherein the actuating lever is provided with a push rod 1 and a push rod 2 extending from its respective sides; and wherein the flat slope and the ridged slope are formed on push rod 1 and push rod 2, respectively.

5. The keyboard key as claimed in claim 1, further comprising an elastic member that is connected to the shell and the actuating lever in order to push the actuating lever towards its initial position.

6. The keyboard key as claimed in claim 1, further comprising a first track, and wherein the guiding structure comprises a second track corresponding to the first orientation and a third track corresponding to the second orientation, and wherein the first track can couple with either the second or third track.

7. The keyboard key as claimed in claim 1, wherein the guide track structure comprises a plurality of tracks corresponding to either the first or second orientation; and wherein the guiding structure comprises a separate track that can join any of the plurality of tracks.

8. The keyboard key as claimed in claim 1, wherein the guide track structure comprises a first plurality of tracks corresponding to either the first or second orientation; and wherein the guiding structure comprises a second plurality of tracks corresponding to either the first or second orientation such that each track of the first plurality of tracks can join a track of the second plurality of tracks.

9. The keyboard key as claimed in claim 1, further comprising a fixed terminal fixed inside the shell, which separates from the movable terminal when the arm spring comes into contact with the flat slope and slips to the end of the flat slope; after the arm spring separates itself from the end of the flat slope and the movable terminal recovers and comes into contact with the fixed terminal, the arm spring comes into contact with the ridged slope and slips to the end of the ridged slope; the arm spring can slip over the ridged structure, and when it separates itself from the end of the flat slope, the movable terminal recovers and comes into contact with the fixed terminal.

10. The keyboard key as claimed in claim 9, wherein, when the arm spring comes into contact with the root of the flat slope or ridged slope, the movable terminal comes into contact with the fixed terminal.

11. The keyboard key as claimed in claim 1, further comprising a base and a translucent cover covering the base; the guide track structure and the movable terminal are provided in the base.

12. The keyboard key as claimed in claim 11, wherein the axial opening is provided in the translucent cover.

* * * * *